United States Patent [19]

Balash et al.

[11] 4,315,628

[45] Feb. 16, 1982

[54] CARD GAME INVOLVING THE TOUCHING OF HUMAN BODY PARTS

[76] Inventors: Charles M. Balash, 7909 Shalimar St., Miramar, Fla. 33023; John R. Hill, 6123 111th Ave., Tampa, Fla. 33617; Paul A. Moore, 6019 Floravista Ave., Tampa, Fla. 33604

[21] Appl. No.: 113,457

[22] Filed: Jun. 23, 1980

[51] Int. Cl.[3] ..... A63F 1/04

[52] U.S. Cl. ..... 273/296; 273/1 G; 273/308

[58] Field of Search ..... 273/292, 308, 1 G

[56] References Cited

U.S. PATENT DOCUMENTS

| | | | |
|---|---|---|---|
| 1,174,783 | 3/1916 | Waream | 273/308 |
| 1,408,952 | 3/1922 | Koelle | 273/292 |
| 3,533,622 | 10/1970 | Foley et al. | 273/1 G |
| 3,652,086 | 3/1972 | Stecker | 273/292 |

OTHER PUBLICATIONS

Playthings, Mar. 1969, p. 86, Advertisement for "Funny Bones" TM.

*Primary Examiner*—Anton O. Oechsle
*Attorney, Agent, or Firm*—Meredith P. Sparks

[57] ABSTRACT

A card game for amusement requiring an active physical participation of the players causing exercising of the human body, comprising a pair of deck of cards of a substantial rectangular shape, said cards of one of said pair of deck of cards having the word Toucher printed on a back side thereof and the other of said pair of deck of cards having the word Touchee printed on a back side thereof for being stacked into two different and distinct stacks of cards, said cards of said pair of deck of cards each having a pictorial representation of a human body part on a front playing side thereof, whereby one player who picked a card from the toucher deck of cards touches with his body part according to the human body part shown on the front playing side of said card the body part of another player according to the human body part shown on the front playing side of a card picked by the other player from the touchee deck of cards thereby causing the players to assume various physical positions resulting in a physical exercise of the body parts thereof.

5 Claims, 8 Drawing Figures

CARD GAME INVOLVING THE TOUCHING OF HUMAN BODY PARTS

BACKGROUND OF THE INVENTION

This invention relates to games, and more particularly to a card playing game for amusement and physical exercise involving the use of human body parts.

The objects of the present invention are to provide a novel card playing game which is played by especially designed cards, is amusing, requires the physical activity of all participating players, is didactic and wholesome, and which can be played by any even number of players, half of which are preferred to be of the opposite sex, and which can be played by any age groups from ten years to adult age.

BRIEF SUMMARY OF THE INVENTION

The card game of the present invention comprises a pair of sets of cards each having printed on a front or face side thereof a pictorial representation of a human body part, one of said sets of cards having the word toucher printed on the back side thereof and the other of said set of cards having the word touchee printed on the back side thereof, and a chart of various parts of a human body, whereby a player touches with a part of his body according to the body part depicted on a card from the toucher set of cards that part of the body of another player according to the part depicted on a card from the touchee set of cards, and scoring according to the human body parts listed on a chart being successfully touched.

DETAILED DESCRIPTION OF THE INVENTION

Figure 1:
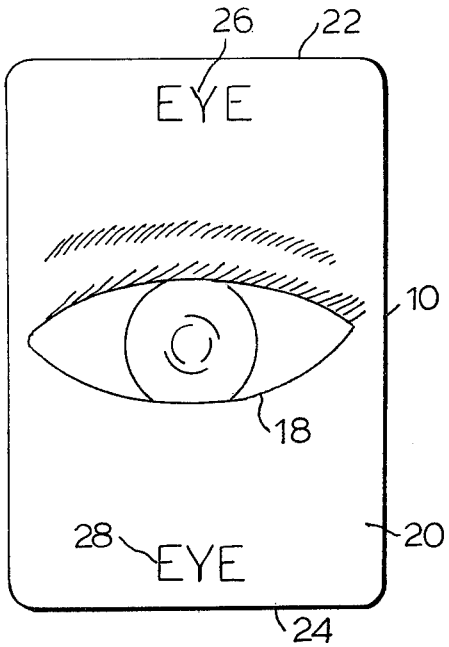
FIGS. 1-4 are plan view of cards each illustrating a human body part depicted on the playing front side face thereof according to the invention.
Figure 2:
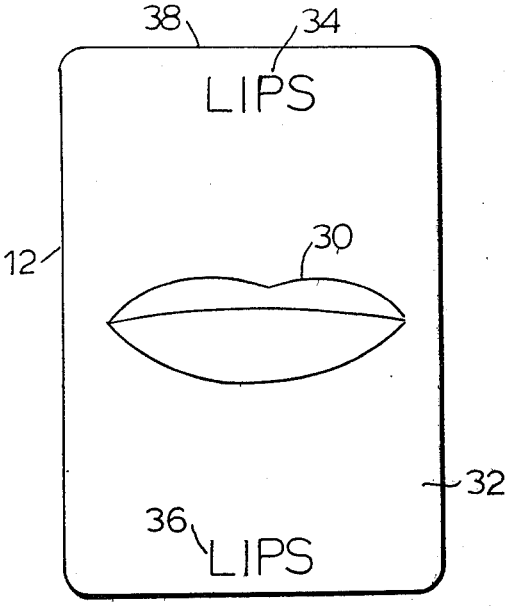
Figure 3:
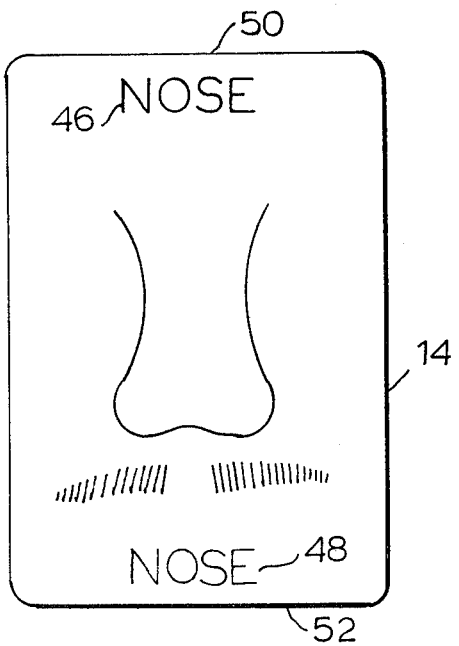
Figure 4:
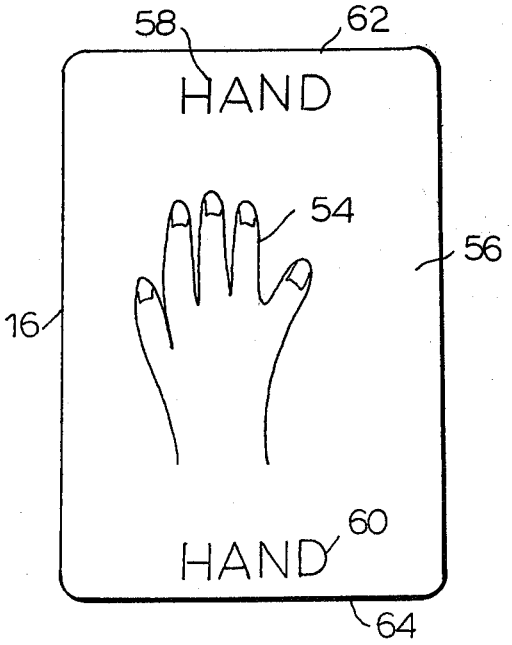

Referring now to the drawings in detail, and in particular to FIGS. 1 to 4, there are illustrated representative playing cards of the game according to the present invention, designated by reference numerals 10,12,14 and 16. The cards 10 to 16 are of a substantially rectangular shape and of the standard dimensions, may be made of cardboard or plastic material, and are relatively thin so that they may be handled with relatively easiness.

The card 10 further has a pictorial representation of a human body part 18, such as an eye, depicted on the front or playing side face 20. The human body part 18 is also identified by its name being written adjacent to the horizontal edges 22 and 24, respectively and designated by numerals 26 and 28.

Similarly, the card 12 is provided with a pictorial representation of lips 30 depicted on the playing face or front side 32, and identified with the words lips, as at 34 and 36, written adjacent to the horizontal edges 38 and 40, respectively. On card 14, there is shown a pictorial representation of a human nose 42 on the front side or face 44, and is identified by the inscription NOSE, as at 46 and 48, respectively, adjacent to horizontal edges 50 and 52.

A further example is shown in card 16 on which a human hand is depicted, as at 54, on the playing face 56, and again, the word HAND is written, as at 58 and 60, adjacent to the lateral edges 62 and 64, respectively.

The parts of the body that will be pictured in both decks are: head, face, eyes, nose, mouth, ears, neck, shoulder, chest, stomach, arm, elbow, wrist, hand, fingers, hip, thigh, knee, calf, ankle, foot, toes, derriere and back. There may be multiple cards with the same body parts in both decks of cards. Additional cards with blank playing sides for both decks are also included for use in the player's own touch instructions.

Figure 5:
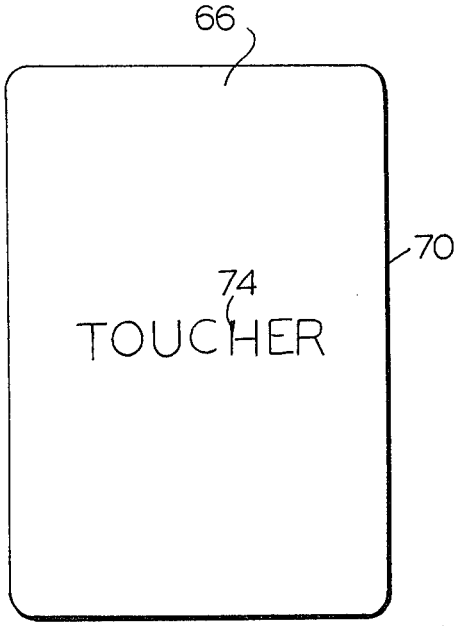
FIG. 5 is a plan view of a card illustrating the back side thereof with the word TOUCHER written thereon.
Figure 6:
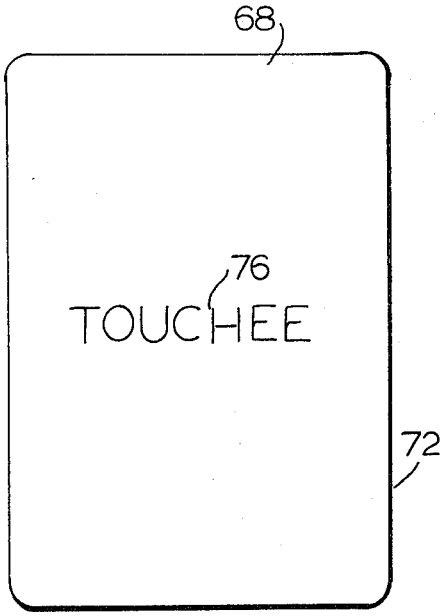
FIG. 6 is a plan view of a card illustrating the back side thereof with the word TOUCHEE written thereon.

In FIGS. 5 and 6, there are shown the back sides 66 and 68 of playing cards 70 and 72 respectively, on one of which there is written the word TOUCHER, designated by numeral 74, and on the other there is written the word TOUCHEE designated by numeral 76. The cards are marked with the words Toucher and Touchee for identification when they are assorted in the proper sets of cards, one of which is to be used by the player who will touch, or the toucher, and the other set of cards is to be used by the player who will be touched, or the touchee. The back side 66 of the toucher's set of cards may also have a fanciful red design (not shown) while the touchee's set of cards may have a fanciful blue design (not shown) for easier identification of each set.

Figure 7:
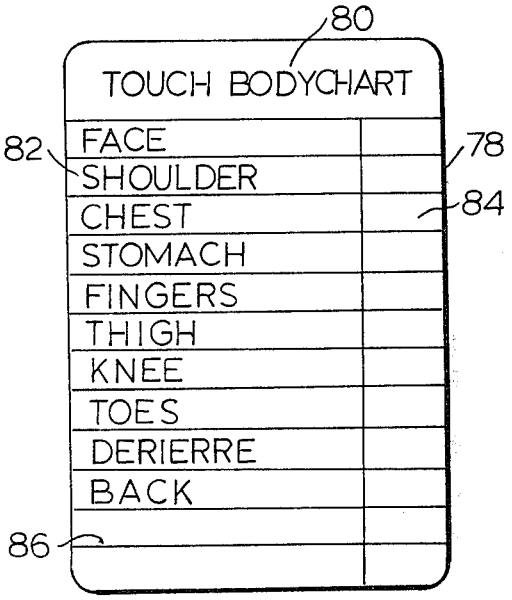
FIG. 7 is a plan view of a chart of the human body parts listed thereon.

In FIG. 7, there is shown a chart 78 with the word BODYCHART 80 written in the top center thereof. The chart 78 contains a list 82 of those human body parts required to be touched in order for one to win in the game. On the right side of the chart 78, there is a square box 84 corresponding to each human body part of the list 82 for making a check mark each time the associated part is touched. Each player is given a pad of chart forms 80 to be used during the game.

The following names may be listed on the bodychart 78: face, shoulder, chest, stomach, fingers, thigh, knee, toes, derriere and back. There are also four blank lines 86 herein provided for adding any other body parts desired in order to customize the game to the players' preference.

In playing the card game of the invention, a number of players take their respective places around a table. Each player is given an identical page from a body chart pad 78. The cards of each set or deck are shuffled well and the card decks are placed on their respective side of the table or, if preferred, on a flat playing board, not shown.

Starting with any player, each player in turn throws a dice, not shown, and the player who rolls the highest number starts the game and is called the TOUCHER. In case of a tie, the dice will be rolled until one of the players rolls a higher number than the other. After the player with the highest mark or number completes his play, the turn to play as the toucher passes to the player to the left or clockwise.

The play consists of taking the top card from the toucher's and the touchee's deck of cards. The toucher's card specifies that part of the body of the player he must use to touch with. The touchee's card specifies the part of the body of another player the toucher must touch.

The dice is rolled again to determine which player is to be the touchee. If less than six players, only one dice is thrown. For more than six, both dice are thrown or rolled. The highest mark or number of the dice rolled identifies the player who will be the touchee and his body will be touched. The toucher then touches with his body part the touchee's body part as indicated by their two cards drawn. If the part of the body that was touched is also a required part, as shown on the body chart 78, a check mark is made on the body chart 78 to indicate the successful completion of touching that part. When a player has all body parts checked on the chart 78 he becomes the winner of the game.

Figure 8:
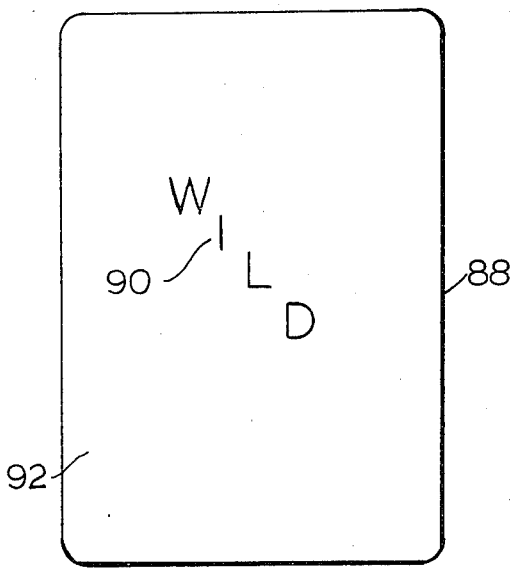
FIG. 8 is a plan view of a card of any of the sets of cards with the word WILD written on the playing face thereof.

There are also wild cards in both decks of cards. A wild card 88 is shown in FIG. 8. The word WILD, designated by numeral 90 is written across the playing face 92 of the card 88. The wild card 88 in the toucher's deck of cards will allow him to use any part of his body to touch with. The wild card 88 in the touchee's deck of cards will allow the toucher to touch any part of the body of the touchee.

If any player is unable to take active part in the game, he will be disqualified for the rest of the game. When the last card of either deck of cards is reached, the deck is reshuffled and, again, is used for continuing the game.

In executing the touching with the body parts according to the game, the players are therefore forced to assume various physical positions, some easy and some difficult, which cause physical exercising of their bodies.

The present invention has been described in detail above by means of a specific example and in a specific embodiment for purposes of illustration only and is not intended to be limited by this description or otherwise, except as defined in the appended claims.

What we claim is:

1. In a game for entertainment with partners chosen by the roll of dice comprising two sets of cards, each set having a back side of a certain color and design, and a front side having a pictorial representation of a part of the human body, and each card of one of said sets of cards having inscribed on the back side thereof the word "toucher", and each card of the other of said sets of cards having inscribed on the back side thereof the word "touchee" for identification of each of said sets of cards, the pictorial representation of a part of the human body on the front side of said card having the word "toucher" inscribed on the back side thereof, being intended to specify the part of the human body to be used to touch with, and the pictorial representation of the part of the human body on the front side of the other of said sets of cards having the word "touchee" inscribed on the back side thereof being intended to specify the part of the human body to be touched, said cards in each of said sets being placed with the front sides thereof facing down for being individually picked in sequence, and a body chart having various human body parts required to be touched for winning listed thereon, whereupon the players assume various physical positions which result in amusement as the player depicted on the back side of the card as "toucher" actually touches with that part of his body designated on the front side of said "toucher" card, that part of the body of the player depicted as "touchee" on the back side of a card selected from the "touchee" set of cards, and then scoring on said body chart according to the human body parts specifically listed on said chart as having been successfully touched.

2. In the game of claim 1, further including cards which depict additional parts of the body which are not listed on said body chart as required for scoring to win the game.

3. In the game of claim 2, said body chart further including blank spaces for later filling in of additional parts of the body not listed.

4. In the game of claim 1, further including additional cards marked "wild" in the "toucher" deck of cards, which allow the "toucher" to use any permissible part of his body for touching the "touchee".

5. In the game of claim 1, further including additional cards marked "wild" in the "touchee" deck of cards, which allow the "toucher" to touch any permissible part of the body of the "touchee".

* * * * *